US010211544B2

(12) United States Patent
Shen et al.

(10) Patent No.: US 10,211,544 B2
(45) Date of Patent: Feb. 19, 2019

(54) COMBINED ANTENNA AND ELECTRONIC DEVICE

(71) Applicant: Lenovo (Beijing) Co., Ltd., Haidian District, Beijing (CN)

(72) Inventors: Jianliang Shen, Beijing (CN); Bin Cui, Beijing (CN)

(73) Assignee: LENOVO (BEIJING) CO., LTD., Haidian District, Beijing (CN)

( * ) Notice: Subject to any disclaimer, the term of this patent is extended or adjusted under 35 U.S.C. 154(b) by 193 days.

(21) Appl. No.: 14/976,118

(22) Filed: Dec. 21, 2015

(65) Prior Publication Data

US 2017/0085010 A1 Mar. 23, 2017

(30) Foreign Application Priority Data

Sep. 23, 2015 (CN) ..... 2015 1 0614242

(51) Int. Cl.

| | |
|---|---|
| ***H01Q 7/06*** | (2006.01) |
| ***H01Q 1/24*** | (2006.01) |
| ***H01Q 21/30*** | (2006.01) |
| ***H01Q 1/38*** | (2006.01) |
| *H01Q 1/48* | (2006.01) |

(52) U.S. Cl.

CPC ..... *H01Q 21/30* (2013.01); *H01Q 1/243* (2013.01); *H01Q 1/38* (2013.01); *H01Q 7/06* (2013.01); *H01Q 1/48* (2013.01)

(58) Field of Classification Search

CPC ..... H01Q 5/20; H01Q 5/30; H01Q 5/307; H01Q 5/342; H01Q 5/35; H01Q 1/2208; H01Q 1/2216; H01Q 1/2225; H01Q 1/2266; H01Q 1/241; H01Q 1/242; H01Q 1/243; H01Q 21/28; H01Q 21/30; H01Q 1/2258;

(Continued)

(56) References Cited

U.S. PATENT DOCUMENTS

| | | | | |
|---|---|---|---|---|
| 9,570,796 | B2 * | 2/2017 | Alrabadi | H01Q 1/243 |
| 2008/0287084 | A1 * | 11/2008 | Krebs | H01Q 1/243 455/271 |

(Continued)

FOREIGN PATENT DOCUMENTS

| | | |
|---|---|---|
| CN | 102709686 | 10/2012 |
| CN | 204189948 U | 3/2015 |
| JP | 2014207516 | 10/2014 |

OTHER PUBLICATIONS

First Office Action dated Sep. 1, 2017 (14 pages including English translation) out of Chinese priority Application No. 201510614242.4.

(Continued)

*Primary Examiner* — Tho G Phan
*Assistant Examiner* — Patrick Holecek
(74) *Attorney, Agent, or Firm* — Brinks Gilson & Lione; John C. Freeman

(57) ABSTRACT

Embodiments of this application provide a combine antenna and an electronic device. The combined antenna includes a first antenna of an electromagnetic induction type and a second antenna of an electromagnetic radiation type. The first antenna includes a substrate having an electrical conductivity with a body portion of the second antenna connected to the substrate of the first antenna, the substrate serving as a reference ground portion of the second antenna.

10 Claims, 3 Drawing Sheets

(58) Field of Classification Search
CPC .. H01Q 7/00; H01Q 7/04; H01Q 7/06; H01Q 1/38; H01Q 1/48
See application file for complete search history.

(56) References Cited

U.S. PATENT DOCUMENTS

| | | | | |
|---|---|---|---|---|
| 2012/0201459 | A1 | 8/2012 | Lin | |
| 2013/0241796 | A1* | 9/2013 | Nagumo ..... | H01Q 1/243 343/861 |
| 2014/0266939 | A1 | 9/2014 | Baringer | |
| 2015/0145742 | A1 | 5/2015 | Cao | |

OTHER PUBLICATIONS

Second Office Action dated Apr. 24. 2018 (12 pages including English translation) from Chinese Priority Patent Application No. 201510614242.4.

* cited by examiner

COMBINED ANTENNA AND ELECTRONIC DEVICE

This application claims priority to Chinese patent application No. 201510614242.4 filed Sep. 23, 2015 the entire contents of which are incorporated herein by reference.

The present application relates to the field of electronic technique, and more particularly, to a combined antenna and an electronic device.

BACKGROUND

With the rapid development of electronic technology, conventional electronic devices often can utilize a variety of antennas to receive different signals, for example, Bluetooth antenna, Near Field Communication (referred to as NFC for short) antenna, wireless charging antenna, etc.

Among them, the NFC antenna and the wireless charging antenna belong to application of electromagnetic induction, the Bluetooth antenna belongs to application of electromagnetic radiation, wherein an antenna of an electromagnetic induction type does not need a reference ground portion, whereas an antenna of an electromagnetic radiation type needs a reference ground portion.

In order to reduce a volume of the antenna of the electromagnetic radiation type, conventionally, the reference ground portion of the antenna of the electromagnetic radiation type is printed on a Printed Circuit Board (referred to as PCB for short) substrate, with a ceramic Bluetooth antenna shown in FIG. 1 as an example, a reference ground portion 12 is printed on a PCB substrate 11, a ceramic portion 13 is connected to the reference ground portion 12, wherein the ceramic portion 13 and the reference ground portion 12 constitute the entire ceramic Bluetooth antenna.

It's worth being noted that, in order to prevent copper coated on the PCB substrate from causing interference to the antenna of the electromagnetic radiation type, the PCB substrate requires a clearance area in the reference ground portion, thereby a dimension of the PCB substrate is increased.

SUMMARY

The present application provides a combined antenna and an electronic device.

A first aspect of the present application provides a combined antenna, comprising a first antenna of an electromagnetic induction type and a second antenna of an electromagnetic radiation type; the first antenna includes a substrate having an electrical conductivity; a body portion of the second antenna is connected to the substrate of the first antenna, the substrate being served as a reference ground portion of the second antenna.

Optionally, the second antenna is connected to a first end of a coaxial cable; a second end of the coaxial cable is connected to a first signal interface on a PCB substrate, so that a signal received by the second antenna is transmitted by the second antenna to the PCB substrate via the first signal interface.

Optionally, said a second end of the coaxial cable is connected to a first signal interface on a PCB substrate comprises: a grounding line and a feeder line of the first antenna, and the second end of the coaxial cable are combined into a connecting line, the connecting line is connected to the first signal interface via an adapter.

Optionally, the combined antenna further comprises a third antenna of an electromagnetic induction type, said a second end of the coaxial cable is connected to a first signal interface on a PCB substrate comprises: a grounding line and a feeder line of the first antenna, a grounding line and a feeder line of the third antenna, and the second end of the coaxial cable are combined into a connecting line, the connecting line is connected to the first signal interface via an adapter.

Optionally, the combined antenna further comprises a ferrite film; a first surface of the substrate is adhered to a first surface of the ferrite film; an antenna coil of the first antenna and an antenna coil of the third antenna are adhered to a second surface of the ferrite film, and the antenna coil of the third antenna is nested in the antenna coil of the first antenna.

Optionally, said a body portion of the second antenna is connected to the substrate of the first antenna specifically is: a grounding end of the body portion of the second antenna is connected to a grounding point on the substrate.

Optionally, that the second antenna is connected to a first end of a coaxial cable specifically comprises: a coaxial outer conductor of the first end of the coaxial cable is connected to the grounding point on the substrate; a coaxial inner conductor of the first end of the coaxial cable is connected to a feeder end of the second antenna.

Optionally, an area on the substrate and corresponding to the second antenna is a clearance area.

A second aspect of the present application provides an electronic device, comprising: a housing; an antenna module disposed within the housing; the antenna module includes a combined antenna that has a first antenna of an electromagnetic induction type and a second antenna of an electromagnetic radiation type; the first antenna includes a substrate having an electrical conductivity; a body portion of the second antenna is connected to the substrate of the first antenna, the substrate being served as a reference ground portion of the second antenna.

Optionally, the electronic device further comprises a PCB substrate. The PCB substrate is disposed within the housing; the second antenna is connected to a first end of the coaxial cable; a second end of the coaxial cable is connected to a first signal interface on the PCB substrate, so that a signal received by the second antenna is transmitted by the second antenna to the PCB substrate via the first signal interface.

BRIEF DESCRIPTION OF THE DRAWINGS

In order to more clearly illustrate the technical solutions in the embodiments of the present application, drawings necessary for describing the embodiments is briefly introduced below, obviously, the drawings described below are a portion of the present application, for those of ordinary skill in the art, it is possible to attain other drawings based on these drawings without paying creative effort.

DETAILED DESCRIPTION

The present application provides a combined antenna and an electronic device, for solving the technical problem of a too large dimension of the PCB substrate caused by the reference ground portion of the antenna of the electromagnetic radiation type in the prior art, its general concept is as below:

A combined antenna comprises a first antenna of an electromagnetic induction type and a second antenna of an electromagnetic radiation type. The first antenna includes a substrate having an electrical conductivity. A body portion of the second antenna is connected to the substrate of the first antenna, the substrate being served as a reference ground portion of the second antenna.

In this way, since in the combined antenna provided by the present application, the second antenna of the electromagnetic radiation type is connected to the substrate of the first antenna of the electromagnetic induction type, the substrate being served as a reference ground portion, thus it avoids disposing the reference ground portion on the PCB substrate, that is to say, the antenna of the electromagnetic radiation type no longer has any requirements with regard to the dimension of the PCB substrate, thus solving the technical problem of a too large dimension of the PCB substrate caused by the reference ground portion of the antenna of the electromagnetic radiation type in the prior art.

Further, since the second antenna of the electromagnetic radiation type no longer takes the PCB substrate as the reference ground portion, the second antenna therefore needs not to be fixedly disposed on the PCB substrate, in this way, the second antenna and the first antenna can be made an integral module connected to the PCB substrate via a conducting wire, their relationship with the PCB substrate is more flexible, which facilitates arrangement of the antennas.

To make the objects, technical solutions, and advantages of the present application more clear and obvious, hereinafter, the technical solutions in the embodiments of the present application is described clearly and comprehensively in combination with the drawings in the embodiments of the present application, obviously, these described embodiments are parts of the embodiments of the present application, rather than all of the embodiments thereof. All the other embodiments obtained by those skilled in the art based on the embodiments of the present application without paying creative efforts fall into the protection scope of the present application.

First Embodiment

Figure 1:
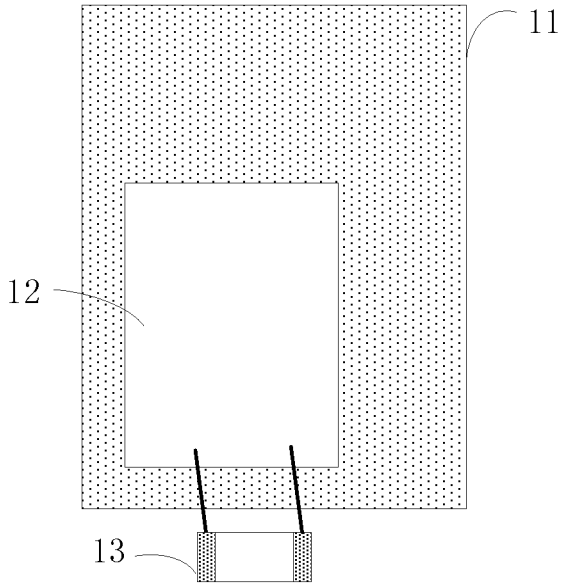
FIG. 1 is a schematic diagram of a ceramic Bluetooth antenna with a PCB substrate as a reference ground.
Figure 2:
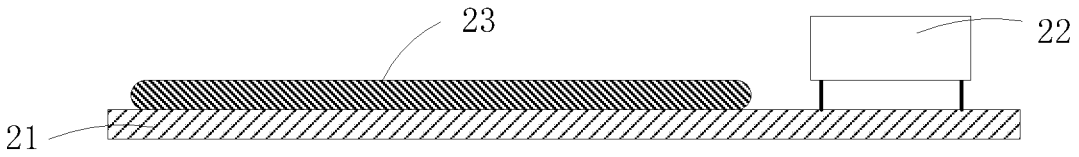
FIG. 2 is a schematic diagram of structure of a combined antenna provided by an embodiment of the present application.

The embodiment of the present application provides a combined antenna, as shown in FIG. 2, the combined antenna comprises a first antenna of an electromagnetic induction type and a second antenna of an electromagnetic radiation type;

the first antenna includes a substrate 21 having an electrical conductivity;

a body portion 22 of the second antenna is connected to the substrate 21 of the first antenna, the substrate being served as a reference ground portion of the second antenna.

Figure 3:
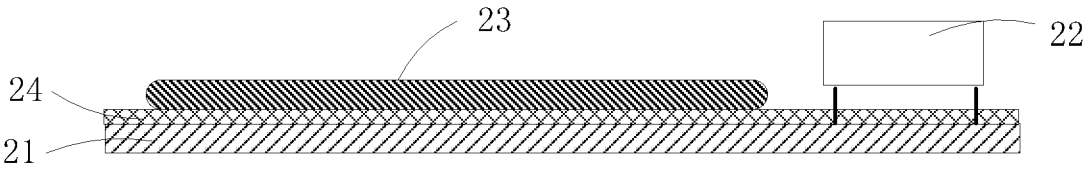
FIG. 3 is a schematic diagram of structure of another combined antenna provided by an embodiment of the present application.

In addition, FIG. 2 further shows an antenna coil 23 of the first antenna, the antenna coil 23 of the first antenna is located on a surface of the substrate 21, in a specific implementation, in order to prevent an electromagnetic field generated by the first antenna from being affected by the substrate 21 having an electrical conductivity and thereby generating a swirl effect, usually it needs to set a ferrite film between the antenna coil 23 of the first antenna and the substrate 21, as shown in FIG. 3, the combined antenna further comprises a ferrite film 24; a first surface of the substrate 21 is adhered to a first surface of the ferrite film 24; the antenna coil 23 of the first antenna is adhered to a second surface of the ferrite film 24.

It needs to be noted that, the second antenna of the electromagnetic radiation type may be a ceramic antenna, in this case, the body portion 22 of the second antenna is a ceramic portion of the ceramic antenna, the second antenna may also be an inverted F-shaped antenna, in this case, the body portion 22 of the second antenna is a metal plate, which being served as a radiator, of the inverted F-shaped antenna. In addition, the second antenna may also be other antennas of the electromagnetic radiation type, the present application makes no limitations thereto, other second antennas obtained by those skilled in the art through reasonable analysis also belong to the protection scope of the present application.

In order to facilitate those skilled in the art better understanding the technical solutions provided by the embodiments of the present application, the combined antenna provided by the embodiments of the present application is described in detail by way of specific examples.

Specifically, in practical application, the second antenna is connected to a first signal interface on a PCB substrate, so that a signal received by the second antenna is transmitted by the second antenna to the PCB via the first signal interface.

It's worth being noted that, if the second antenna is a Bluetooth antenna, since the Bluetooth antenna transmits a high-frequency signal, thus in a possible implementation of an embodiment of the present application, the second antenna is connected to a first end of a coaxial cable; a second end of the coaxial cable is connected to a first signal interface on a PCB substrate, so that a signal received by the second antenna is transmitted by the second antenna to the PCB via the first signal interface.

Next, the connection between the second antenna and the first end of the coaxial cable is illustrated in detail.

First, the connection between the body portion of the second antenna and the substrate specifically is: a grounding end of the body portion 22 of the second antenna is connected to a grounding point on the substrate 21. That the second antenna is connected to a first end of a coaxial cable specifically is: a coaxial outer conductor of the first end of the coaxial cable is connected to the grounding point on the substrate 21; a coaxial inner conductor of the first end of the coaxial cable is connected to a feeder end of the second antenna.

Figure 4:
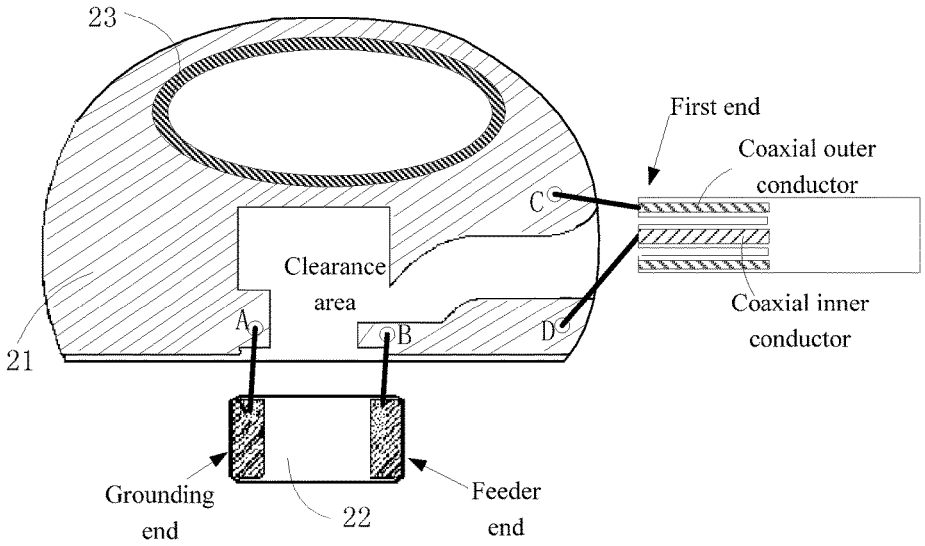
FIG. 4 is a schematic diagram of a connection between a coaxial cable and a second antenna provided by an embodiment of the present application.

Exemplarily, as shown in FIG. 4, the substrate 21 includes a grounding point A and a grounding point C thereon, the grounding end of the body portion 22 of the second antenna is welded with the grounding point A, the coaxial outer conductor of the first end of the coaxial cable is welded with the grounding point C, the grounding point A and the grounding point C are located on the same slice of coated copper, thus implementing the connection between the coaxial outer conductor of the coaxial cable and the grounding end of the body portion 22 of the second antenna; in addition, the substrate 21 further includes a connecting point B and a connecting point D located on the same slice of coated copper, wherein the feeder end of the body portion 22 of the second antenna is welded with the connecting point B, the coaxial inner conductor of the first end of the coaxial cable is welded with the connecting point D, thus implementing the connection between the coaxial inner conductor of the coaxial cable and the feeder end of the body portion 22 of the second antenna.

Optionally, an area on the substrate and corresponding to the second antenna is a clearance area.

Illustration is provided still with FIG. 4 as an example, as shown in FIG. 4, the substrate 21 includes a clearance area thereon, no conductive material is included in the clearance area, that is, it avoids generating interference to a normal operation of the second antenna.

In comparison to that a clearance area needs to be reserved on the PCB substrate as a reference ground for the antenna of the electromagnetic radiation type in the prior art, in the embodiment of the present application, the second antenna regards the substrate as the reference ground portion, which thereby avoids disposing the reference ground portion on the PCB substrate, and further solves the technical problem of a too large dimension of the PCB substrate caused by the reference ground portion of the antenna of the electromagnetic radiation type in the prior art.

It's worth being noted that, since the grounding end and the feeder end of the first antenna may also be connected to the PCB substrate, thus, in order to simplify the connection between the combined antenna and the PCB substrate, in a possible implementation of the embodiment of the present application, the grounding line and the feeder line of the first antenna, and the second end of the coaxial cable are combined into a connecting line, the connecting line, i.e., a conducting line, is connected to the first signal interface via an adapter.

Figure 5:
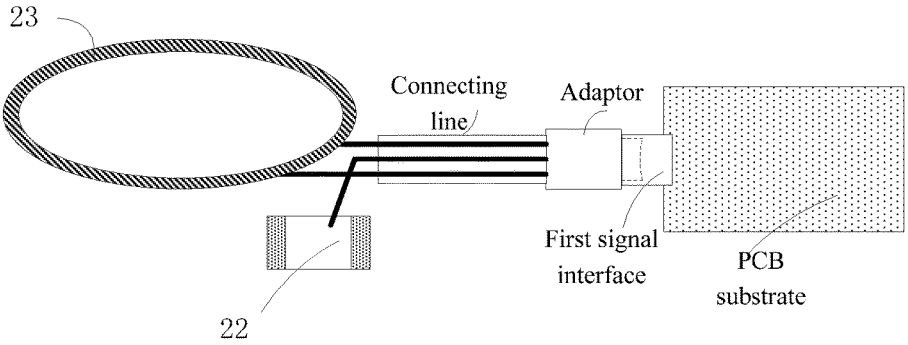
FIG. 5 is a schematic diagram of a connection between a combined antenna and a PCB substrate provided by an embodiment of the present application.

As shown in FIG. 5, the connecting line shown therein includes a coaxial cable to which the second antenna corresponds, and the grounding line and the feeder line of the first antenna, one end of the connecting line is connected to an adapter, the adapter is connected to the first signal interface on the PCB substrate. It needs to be noted that, the antenna coil 23 of the first antenna and the body portion 22 of the second antenna both are located on the substrate 21, please refer to FIG. 4 in particular, FIG. 5 mainly is to reflect the connection relationship between the combined antenna and the PCB substrate, thus the substrate 21 and the ferrite film 24 are not shown therein.

In another possible implementation of the embodiment of the present application, the combined antenna further comprises a third antenna of an electromagnetic induction type, said a second end of the coaxial cable is connected to a first signal interface on a PCB substrate comprises:

a grounding line and a feeder line of the first antenna, a grounding line and a feeder line of the third antenna, and the second end of the coaxial cable are combined into a connecting line, the connecting line is connected to the first signal interface via an adapter.

Figure 6:
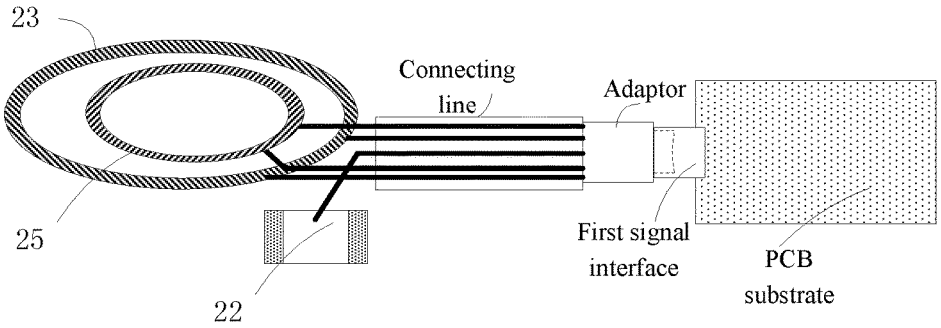
FIG. 6 is a schematic diagram of another connection between a combined antenna and a PCB substrate provided by an embodiment of the present application.

As shown in FIG. 6, the connecting line shown therein includes a coaxial cable to which the second antenna corresponds, the grounding line and the feeder line of the first antenna, and the grounding line and the feeder line of the third antenna, one end of the connecting line is connected to an adapter, the adapter is connected to the first signal interface on the PCB substrate. It needs to be noted that, the antenna coil 23 of the first antenna, the body portion 22 of the second antenna, and the antenna coil 25 of the third antenna all are located on the substrate 21, FIG. 6 mainly is to reflect the connection relationship between the combined antenna and the PCB substrate, thus the substrate 21 and the ferrite film 24 are not shown therein.

In conjunction with FIGS. 5 and 6 it can be known that, the combined antenna, as an integral module, may be connected to the PCB substrate via a connecting line, in this way, the second antenna does not need to be welded on the PCB substrate, thus the positional relationship between the combined antenna and the PCB substrate is more flexible, which facilitates arrangement of the antennas.

Optionally, an antenna coil of the first antenna and an antenna coil of the third antenna are adhered to a second surface of the ferrite film, and the antenna coil of the third antenna is nested in the antenna coil of the first antenna.

Figure 7:
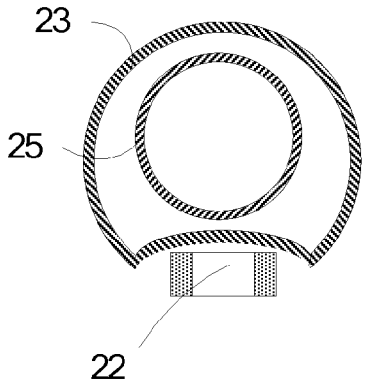
FIG. 7 is a schematic diagram of positional relationship arrangement of a combined antenna provided by an embodiment of the present application.

It needs to be noted that, the present application makes no limitations to the positional arrangement of the first antenna, the second antenna, and the third antenna on the substrate, for example, as shown in FIG. 7, the antenna coil 23 of the first antenna includes a depressed part, so as to reserve space for the body portion 22 of the second antenna, the antenna coil 25 of the third antenna is nested in the antenna coil 23 of the first antenna to save space. Other arrangement manners that are conceivable for those skilled in the art through rational analysis are also within the protection scope of the present application.

It's worth being noted that, in a preferred implementation of the embodiment of the present application, the antenna may be a combination of a wireless charging antenna and a ceramic Bluetooth antenna, that is, in FIGS. 2, 3, 4, and 5, the first antenna is a wireless charging antenna, the second antenna is ceramic Bluetooth antenna. The combined antenna may also be a combination of a Near Field Communication (referred to as NFC for short) antenna and a ceramic Bluetooth antenna, that is, in FIGS. 2, 3, 4, and 5, the first antenna is the NFC antenna, the second antenna is ceramic Bluetooth antenna. The antenna may also be a combination of the wireless charging antenna, the ceramic Bluetooth antenna, and the NFC antenna, that is, in FIGS. 6 and 7, the first antenna is the wireless charging antenna, the second antenna is the ceramic Bluetooth antenna, and the third antenna is the NFC antenna.

Second Embodiment

Figure 8:
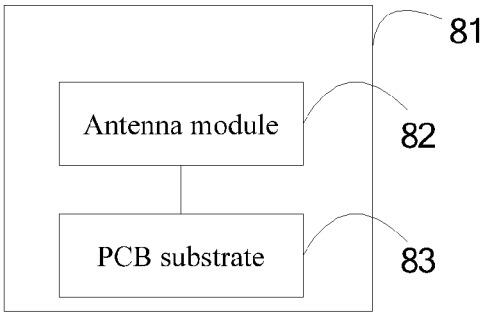
FIG. 8 is a schematic diagram of structure of an electronic device provided by an embodiment of the present application.

The embodiment of the present application provides an electronic device, as shown in FIG. 8, the electronic device comprising:

a housing 81;

an antenna module 82 disposed within the housing 81;

the antenna module includes a combined antenna that has a first antenna of an electromagnetic induction type and a second antenna of an electromagnetic radiation type;

the first antenna includes a substrate having an electrical conductivity;

a body portion of the second antenna is connected to the substrate of the first antenna, the substrate being served as a reference ground portion of the second antenna.

It needs to be noted that, as for specific implementations of the combined antenna, consulting may be made to the associated contents in the First Embodiment described in the above, for brevity of description, no more details repeated here.

Optionally, as shown in FIG. 8, the electronic device further comprises a PCB substrate 83;

the PCB substrate 83 is disposed within the housing 81;

the second antenna is connected to a first end of the coaxial cable; a second end of the coaxial cable is connected to a first signal interface on the PCB substrate, so that a signal received by the second antenna is transmitted by the second antenna to the PCB substrate via the first signal interface.

It needs to be noted that, as for specific implementations of the connection between the combined antenna and the PCB substrate, consulting may be made to the associated contents in the First Embodiment described in the above, for brevity of description, no more details repeated here.

Optionally, the electronic device may be a Personal Computer (referred to as PC for short), a Portable Android Device (referred to as PAD for short), a mobile phone, and other different electronic devices, the present application makes no limitations thereto.

Figure 9:
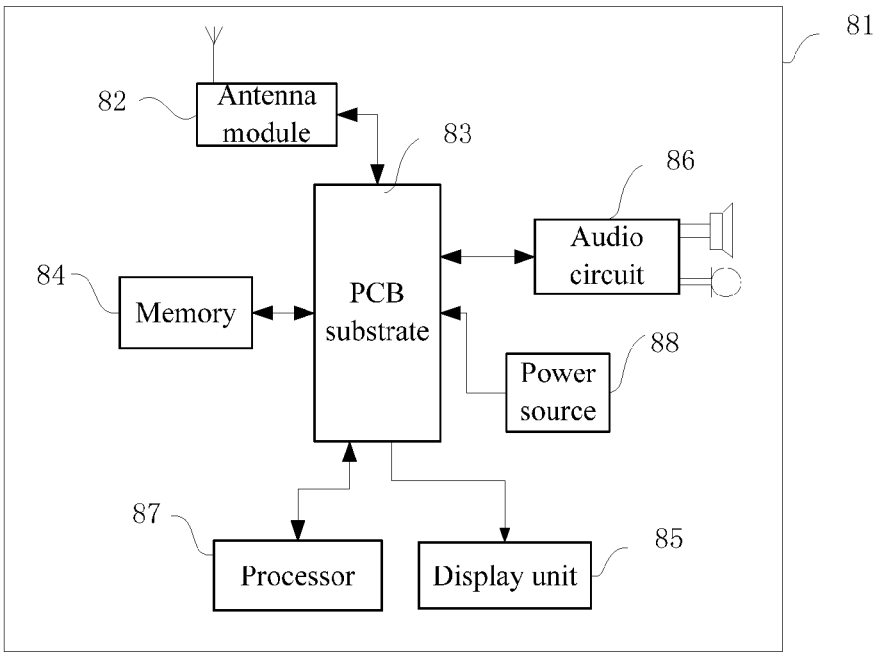
FIG. 9 is a schematic diagram of a mobile phone provided by an embodiment of the present application.

Illustration is provided below with the mobile phone as an example, FIG. 9 illustrates a block diagram of a partial structure associated with each embodiment of the present application, as shown in FIG. 9, when the electronic device is a mobile phone, the electronic device further comprises components such as: a memory 84, a display unit 85, an audio circuit 86, a processor 87, and a power source 88.As is appreciated by those skilled in the art, the structure of the mobile phone in FIG. 9 does not constitute a limitation to the mobile phone, the mobile phone may include components more or less than those shown therein, or combine some components, or have a different component arrangement.

When adopting the electronic device provided by the present application, in the combined antenna comprised by the electronic device, the second antenna of the electromagnetic radiation type is connected to the substrate of the first antenna of the electromagnetic induction type, the substrate being served as a reference ground portion, thus it avoids disposing the reference ground portion on the PCB substrate, that is to say, the antenna of the electromagnetic radiation type no longer has any requirements with regard to the dimension of the PCB substrate, thus solving the technical problem of a too large dimension of the PCB substrate caused by the reference ground portion of the antenna of the electromagnetic radiation type in the prior art.

Further, since the second antenna of the electromagnetic radiation type no longer takes the PCB substrate as the reference ground portion, the second antenna therefore needs not to be fixedly disposed on the PCB substrate, in this way, the second antenna and the first antenna can be made an integral module connected to the PCB substrate via a conducting wire, their relationship with the PCB substrate is more flexible, which facilitates arrangement of the antennas.

Although the preferred embodiments of the present application have been described, those skilled in the art can make additional changes and modifications to these embodiments once learning the basic inventive concepts thereof. Therefore, the appended claims are intended to be interpreted as including the preferred embodiments as well as all changes and modifications that fall into the scope of the present application.

Obviously, those skilled in the art can make various modifications and variations to the present application without departing from the spirit and scope thereof. Thus, if these modifications and variations of the present application are within the scope of the claims of the application as well as their equivalents, the present application is also intended to include these modifications and variations.

The invention claimed is:

1. A combined antenna comprising:

a first antenna of an electromagnetic induction type;

a second antenna of an electromagnetic radiation type;

a ferrite film, wherein the first antenna includes a substrate having an electrical conductivity and a body portion of the second antenna is connected to the substrate of the first antenna, the substrate serving as a reference ground portion of the second antenna and a first surface of the substrate is adhered to a first surface of the ferrite film, and an antenna coil of the first antenna is adhered to a second surface of the ferrite film:

wherein the substrate lacks a signal processing circuit, and the second antenna is connected to a signal interface on a Printed Circuit Board (PCB) substrate via a connecting line, the PCB substrate comprising a signal processing circuit for a signal received by the second antenna, and the PCB substrate being disposed separately from the substrate.

2. The combined antenna according to claim 1, wherein the second antenna is connected to a first end of a coaxial cable and a second end of the coaxial cable is connected to the signal interface on the PCB substrate so that the signal received by the second antenna is transmitted by the second antenna to the PCB substrate via the signal interface.

3. The combined antenna according to claim 2, wherein a grounding line and a feeder line of the first antenna, and the second end of the coaxial cable is combined into the connecting line, the connecting line is connected to the signal interface via an adapter.

4. The combined antenna according to claim 2, wherein the combined antenna further comprises a third antenna of an electromagnetic induction type, and a first grounding line and a first feeder line of the first antenna, a second grounding line and a second feeder line of the third antenna, and the second end of the coaxial cable is combined into the connecting line, the connecting line is connected to the signal interface via an adapter.

5. The combined antenna according to claim 4, wherein an antenna coil of the first antenna and an antenna coil of the third antenna are adhered to a second surface of the ferrite film, and the antenna coil of the third antenna is nested in the antenna coil of the first antenna.

6. The combined antenna according to claim 2, wherein the body portion of the second antenna includes a grounding end of the body portion of the second antenna connected to a grounding point on the substrate.

7. The combined antenna according to claim 6, wherein the second antenna comprises:

a coaxial outer conductor of the first end of the coaxial cable connected to the grounding point on the substrate;

a coaxial inner conductor of the first end of the coaxial cable connected to a feeder end of the second antenna.

8. The combined antenna according to claim 1 wherein an area on the substrate and corresponding to the second antenna is a clearance area.

9. An electronic device, comprising:

a housing;

an antenna module disposed within the housing;

a Printed Circuit Board (PCB) substrate disposed within the housing;

the antenna module comprises a combined antenna that comprises a first antenna of an electromagnetic induction type and a second antenna of an electromagnetic radiation type;

the first antenna comprises a substrate having an electrical conductivity; and a body portion of the second antenna is connected to the substrate of the first antenna, the substrate serving as a reference ground portion of the second antenna and a first surface of the substrate is adhered to a first surface of a ferrite film, and an antenna coil of the first antenna is adhered to a second surface of the ferrite film:

wherein the substrate lacks a signal processing circuit, and the second antenna is connected to a signal interface on the Printed Circuit Board (PCB) substrate via a connecting line, the PCB substrate comprising a signal processing circuit for a signal received by the second antenna, and the PCB substrate being disposed separately from the substrate.

10. The electronic device according to claim 9, wherein the second antenna is connected to a first end of a coaxial cable; a second end of the coaxial cable is connected to the signal interface on the PCB substrate, so that the signal received by the second antenna is transmitted by the second antenna to the PCB substrate via the first signal interface.

* * * * *